United States Patent [19]

Dreissigacker et al.

[11] Patent Number: 4,875,674

[45] Date of Patent: Oct. 24, 1989

[54] ENERGY ABSORBING MEANS WITH SELF CALIBRATING MONITOR

[75] Inventors: Peter D. Dreissigacker, Stowe; Richard A. Dreissigacker, Morrisville, both of Vt.

[73] Assignee: Concept II, Inc., Morrisville, Vt.

[21] Appl. No.: 231,679

[22] Filed: Aug. 12, 1988

Related U.S. Application Data

[63] Continuation-in-part of Ser. No. 14,234, Feb. 12, 1987, abandoned.

[51] Int. Cl.[4] ..... A63B 21/22; G01L 25/00

[52] U.S. Cl. ..... 272/72; 272/116; 272/129; 272/130; 272/132; 272/DIG. 6; 73/1 R; 73/125; 73/379; 364/571.04

[58] Field of Search ..... 73/1 R, 379, 9, 1 B, 73/121, 123, 125, 126, 862.09; 364/511, 571.01, 571.02; 571.04, 506, 561, 551.01; 272/72, 128, 131, 132, 130, 133, DIG. 5, DIG. 6, 116, 129; 377/23

[56] References Cited

U.S. PATENT DOCUMENTS

| | | | |
|---|---|---|---|
| 3,657,926 | 4/1972 | Munson et al. | 73/1 R X |
| 3,859,840 | 1/1975 | Gause | 73/1 R |
| 3,962,914 | 6/1976 | Lutz | 73/125 |
| 3,967,503 | 7/1976 | Svensson | 73/379 |
| 4,141,248 | 2/1979 | Bargenda | 73/379 |
| 4,396,188 | 8/1983 | Dreissigacker et al. | 272/72 |
| 4,537,396 | 8/1985 | Hooper | 272/72 X |
| 4,674,741 | 6/1987 | Pasierb, Jr. et al. | 272/72 |
| 4,800,513 | 1/1989 | Deutsch | 73/1 R X |

OTHER PUBLICATIONS

Gyrating-Mass Test Rig for Hoisting Gear Brakes, W. Arndt et al., Monthly Technical Review, vol. 16, No. 11, 11-1972, pp. 200-203.

*Primary Examiner*—Richard J. Apley
*Assistant Examiner*—David J. Bender
*Attorney, Agent, or Firm*—Thomas N. Neiman

[57] ABSTRACT

The apparatus is adapted to an exercise device with an energy absorbing unit that has a self calibrating energy monitor. It comprises at least one rotating flywheel which is driven through a one way clutch. There is a braking mechanism to apply resistance to the flywheel. A self calibrating energy monitor computes the dissipated power with a formula relating power to angular velocity, typically a coefficient of resistance times the angular velocity of the flywheel raised by an exponent determined by the brake used. The monitor consists of a microprocessor that is programmed to periodically self calibrate the formula and receives its impulses from a sensor.

3 Claims, 3 Drawing Sheets

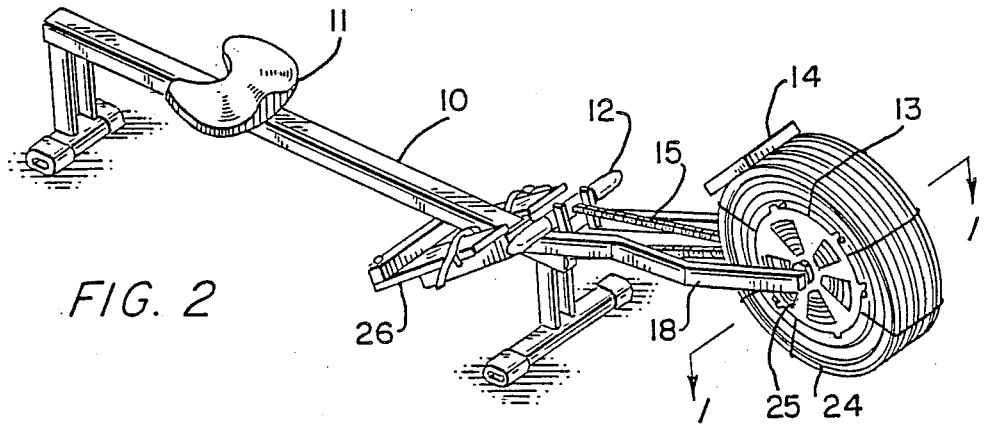
FIG. 2
FIG. 1
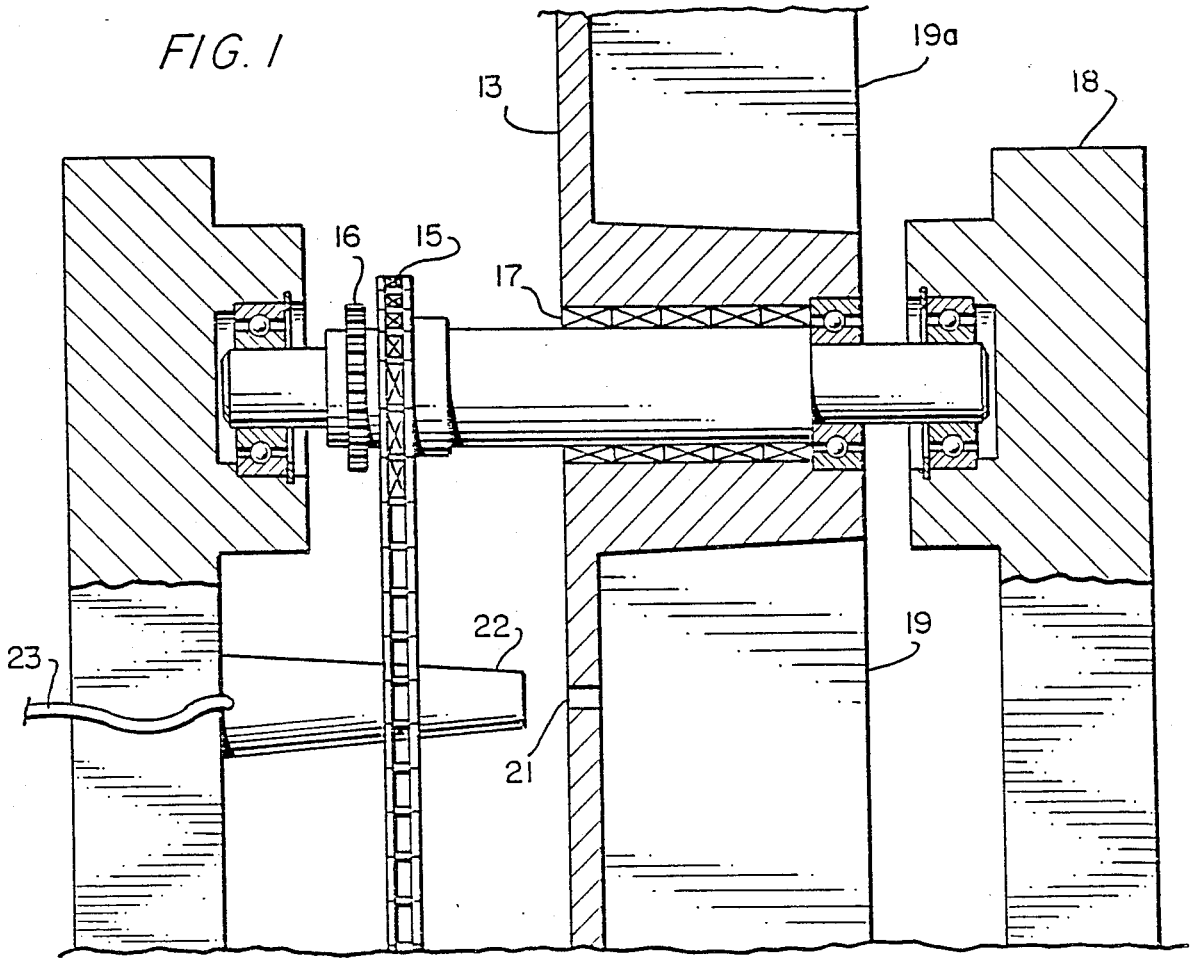

ENERGY ABSORBING MEANS WITH SELF CALIBRATING MONITOR

This is a continuation-in-part of our co-pending application number 07/014,234 originally filed on Feb. 12, 1987, now abandoned.

This invention pertains to exercise devices and, in particular, to an exercise device having an energy absorbing means with a self calibrating energy monitor which allows the user to monitor the amount of actual power that he or she may be producing.

The increased interest in exercise, both on an individual bases and in a club type setting, has resulted in an ever increasing need for an apparatus that, in addition to providing the needed exercise for the participant, would allow that individual to accurately and repeatedly monitor the actual power produced regardless of conditions. This is accomplished by using an energy absorbing means and a self calibrating energy monitoring means. A number of current types of devices have made inroads into this area. The applicants own device—U.S. Pat. No. 4,396,188 issued in August 1983—should be included in this group. The U.S. Pat. Nos. issued to Evan Flavell, 3,848,467 and 3,869,121 for a Proportional Resistance Exercise Servo System, shows a device which applies braking force that determines movement in two directions and automatically releases that braking force and reverses the power applied and braking as programmed. The U.S. Pat. No. 4,423,630 issued to Thomas R. Morrison, shows a device which measures the power applied to the device and calculates the amount of work accomplished.

It is the object of this invention to teach the use of an exercise device which will measure the power output of a flywheel. It is also the object of this invention to teach the use of an exercise device which will measure the performance of the workout, both on an immediate bases and an overall average basis. It is another object of this invention to teach an exercise device that will allow the user to adjust the resistance of the flywheel to permit a heavier or lighter feel for the effort expended. An additional object of this invention is to teach means of measuring signals from the flywheel on every revolution or fraction thereof.

Also, it is the object of this invention to teach an energy absorbing means with self calibrating monitor for exercise machines or the like, comprising a frame; at least one rotating member with a known moment of inertia rotatably journaled in said frame; brake means for applying variable resistance to said rotating member; means for driving said rotating member; said drive means is connected to said rotating member by clutch means; said clutch means has release means to allow said rotating member to be disengaged from said drive means; means for measuring angular velocity of said rotating member; calculating means for computing the power dissipation of said brake means by use of a predetermined formula relating power and said angular velocity; means for periodically calibrating said formula by alternatively calculating said power during the disengagement of said rotating member from said drive means; and using said alternative calculation to recalibrate said formula. Finally, it is the object of this invention to teach a cyclical exercise machine, comprising a frame; at least one bearing mounted on said frame; axle means mounted in said bearing; a rotatable member; one way clutch means attached to said rotating member and engaging said axle means to said rotating member; means of applying braking resistance to said rotating member; drive means; handle menas attached to one end of said drive means; at least one connecting means rigidly attached to said axle means engaging said drive means; and return means attached to said drive means at a point beyond said engaging means to retract said drive means and said handle means in between power strokes.

Further objects of this invention, as well as the novel features thereof, will become more apparent by reference to the following description taken in conjunction with the following figures, in which:

FIG. 1 is a cross-sectional view of the novel flywheel assembly taken along line 1—1 of FIG. 2 with the wire guard removed;

FIG. 2 is a perspective view of the exercise device;

Figure 3:
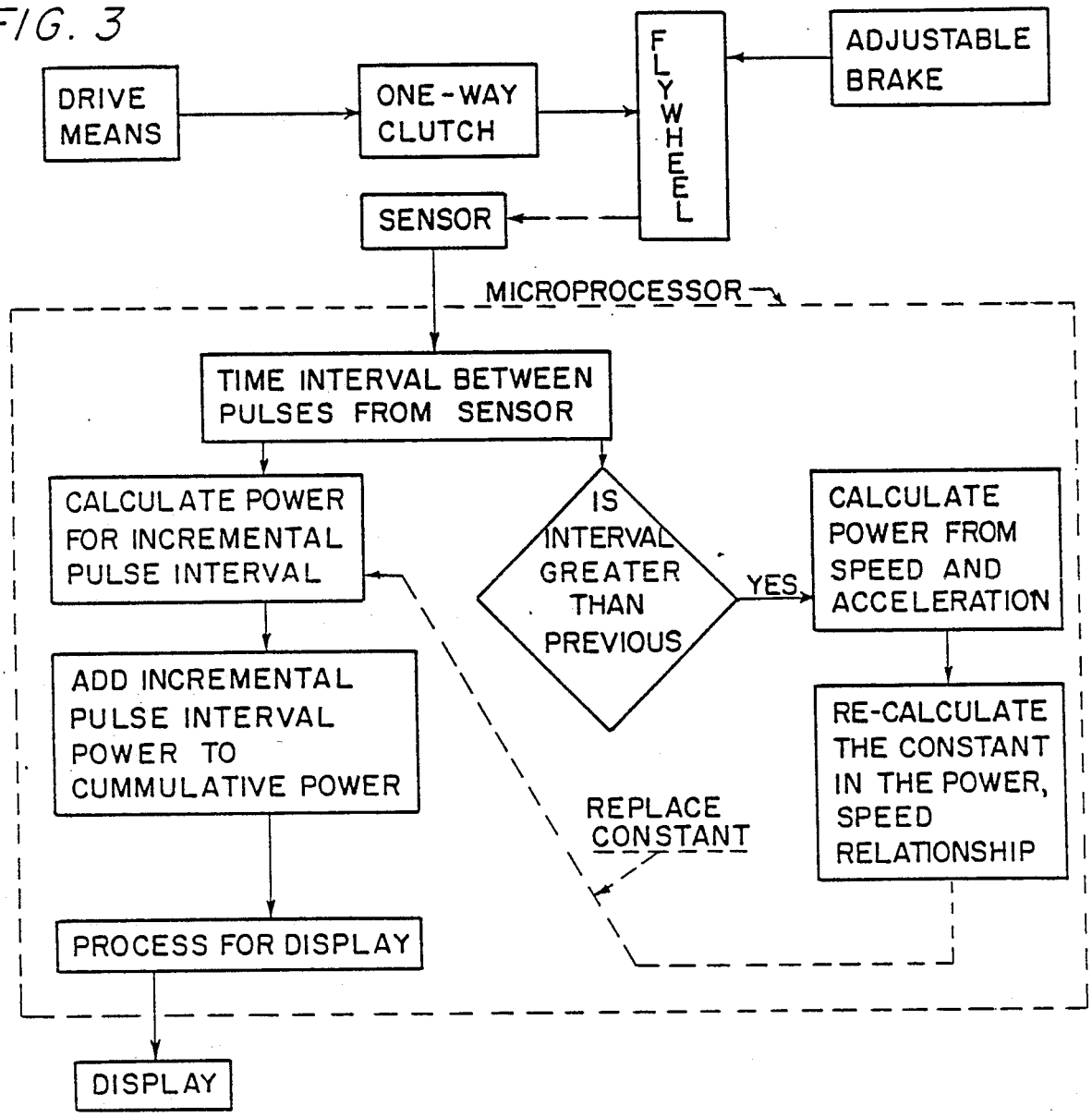
FIG. 3 is a schematic block diagram of the novel means.
Figure 4:
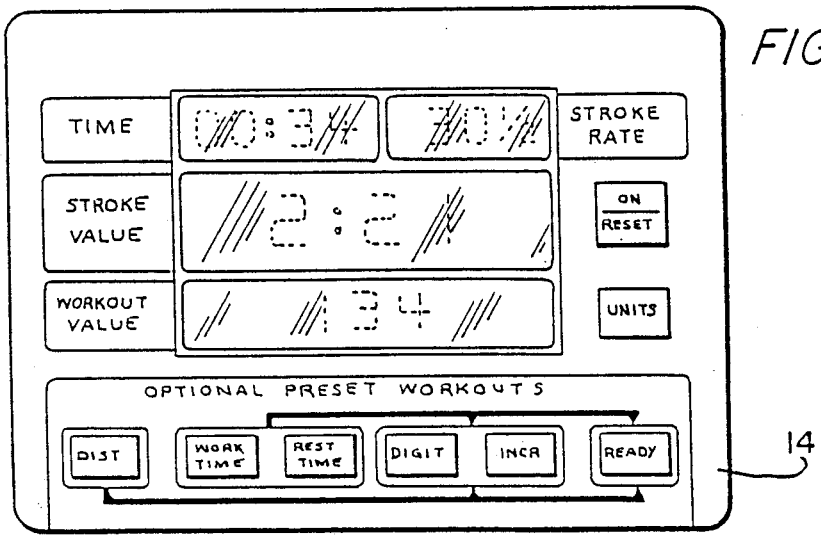
FIG. 4 is a frontal view of the monitor panel.
Figure 5:
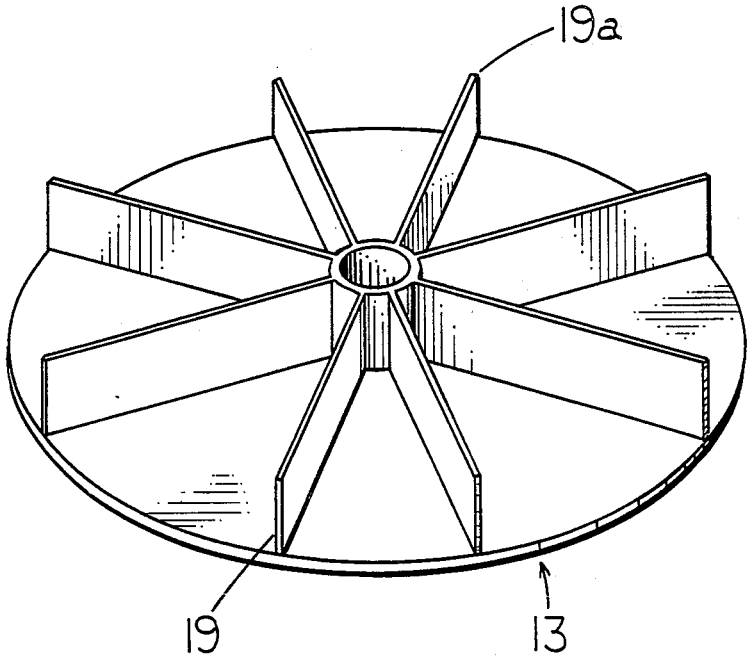
FIG. 5 is an enlarged perspective view of the flywheel with fan blades.

As shown in the figures, the exercise device 10, comprises a seat assembly 11, a rowing mechanism 12 and a flywheel assembly 13 together in one unit. A monitoring panel 14 is attached to the flywheel assembly 13. The rowing mechanism 12 is attached to a chain 15 that is looped around a gearing assembly 16 that is rigidly attached to an axle that is supported by bearings mounted on the frame. A one way clutch 17 is fixed to the flywheel which engages the axle. The one-way clutch 17 consists of a standard clutch mechanism which allows the wheel to rotate freely in one direction relative to the shaft and resist rotation in the opposite direction relative to the shaft.

The frame 18 holds the seat assembly 11, the rowing mechanism 12, and the flywheel assembly 13. The flywheel assembly 13 contains a plurality of fan blades 19 and **19*a*. The flywheel assembly has one or more magnets 21 attached. As the flywheel 13 is rotated, the magnets 21 pass by a sensor 22 which sends a signal to the microprocessor through a circuit 23. A screenguard 24 is provided to prevent contact with the rotating flywheel. This guard also has a airflow control 25 which may be opened and closed to allow more or less air to reach the fan blades. When the airflow control is closed, the operator will feel less resistance due to the fact that less air is being moved by the fan. A footrest assembly 26** is provided for the support of the operator.

As shown in the schematic block diagram, FIG. 3, as the flywheel is rotated the sensor 22 measures the angular velocity by means of the timing of the magnets passing the sensor. This information is passed to a microprocessor that has been preprogrammed to be a self calibrating monitor. The monitor works on the principle that the power dissipated by the braking means equals or can be closely approximated by a coefficient of resistance times the angular velocity of the flywheel raised by an exponent, i.e. Power=Coefficient of resistance×(Angular Velocity) Exponent. The value of the exponent is predetermined and programmed into the microprocessor. The selection of this value wil have some bearing on the accuracy of the power calculation. The value of the exponenet can either be derived mathematically or determined experimentally. Described below are two specific examples of mathematical selection and a general description of an experimental method. For instance, the exponent for mechanical friction braking would be one since the braking torque is not dependent on angular velocity, and power is the product of torque and angular velocity. Thus power is proportional to the first power of angular velocity. In the case of fan resistance, the braking torque is a function of angular velocity squared and power is the product of torque and angular velocity. Thus power is proportional to the angular velocity to the third power. This is a common relationship used in fan design. The relationship between power and angular velocity can be determined experimentally by measuring the the power dissipated at various velocities covering the operating range of the brake. The curve defined by these points will determine the power—angular velocity relationship.

The value of the coefficient of resistance depends on various conditions affecting the braking means as air density, lubrication, heat, etc. This value will be periodically recalibrated as described below. Each time the microprocessor receives a pulse from the magnet(s) that increment of power is calculated using the power/angular velocity relationship and added to the previously calculated increments. Using this relationship, the power dissipated is calculated continuously and displayed in a useful form to the operator. It should be noted that this power/angular velocity relationship is valid for calculating power dissipated regardless of any external power being applied to the flywheel. The microprocessor has a function to recalculate the coefficient of resistance during the period of clutch disengagement when the flywheel is decelerating under the influence of only the resistance. Under these conditons, when the only power acting on the flywheel is that of the braking means, the power dissipated can also be computed using angular velocity, angular deceleration and the moment of inertia of the flywheel. The formulas involved are : Torque=Moment of Inertia×Angular Acceleration (or deceleration) and Power=Torque×Angular Velocity. Combining these formulas, we get Power=Moment of Inertia× Angular Velocity-×Angular Acceleration. Thus the power at a given angular velocity can be calculated. The micrprocessor is programmed with the necessary functions to do the rapid calculations required to process and display the desired information. The moment of inertia is preprogrammed into the microprocessor. The time between the pulses gives the angular velocity of the flywheel and the change in time between successive pairs of pulses is the acceleration (deceleration). Now that the power dissipated has been calculated using this alternative method, which is valid only during a period of clutch disengagement, the coefficient of resistance can be recalculated by rearranging the power/angular velocity relationship as follows: Coefficient of Resistance=-Power÷(Angular Velocity) Exponent. This newly calibrated value for the coefficient of resistance is then used in the power/angular velocity relationship to calculate power dissipated until the next opportunity for recalibration. In this way, the monitor is self calibrating to account for changing conditions.

The information displayed by the monitor can be tailored to suit the particular application, i.e. power of each stroke, average power, predicted speed of a rower if his output was applied to an actual boat on the water, etc. The method of operation of this invention results in a constant correction of the various factors that can change by measuring the deceleration of the flywheel during the recovery phase of the cycle. The monitor panel 14 comprises a plurality of touchpads and displays. The information can be provided includes but is not limited to time, stroke rate, individual stroke output, overall workout time and total output.

While we have described our invention in connection with a specific embodiment thereof, it is clearly to be understood that this is done only by way of example and not as a limitation to the scope of our invention as set forth in the objects thereof and in the amended claims.

We claim:

1. An energy absorbing means with self calibrating monitor for exercise, comprising:

a frame;

at least one rotating member with a knowm moment of inertia rotatably jounaled in said frame;

brake means for applying variable resistance to said rotating member;

means for driving said rotating member for allowing the human operator to initiate the action of said rotating member by using said drive means;

said drive means is connected to said rotating member by clutch means;

said clutch means has release means to allow said rotating member to be disengaged from said drive means;

means for measuring angular velocity of said rotating member;

calculating means for computing the power dissipation of said brake means by use of a predetermined formula relating power and said angular velocity;

means for periodically calibrating said formula by alternatively calculating the power during the disengagement of said rotating member from said drive means; and using said alternative calculation to recalibrate said formula.

2. An energy absorbing means with self calibrating monitor, according to claim 1, wherein:

said calculating means has display means.

3. An energy absorbing means with self calibrating monitor, according to claim 2, wherein:

said calculating means has additional means to measure and display the rate of said engagement and disengagement of said drive means.

* * * * *